US008313169B2

(12) United States Patent
Iketani et al.

(10) Patent No.: US 8,313,169 B2
(45) Date of Patent: Nov. 20, 2012

(54) LIQUID-EJECTING HEAD

(75) Inventors: Masaru Iketani, Atsugi (JP); Kiyomitsu Kudo, Machida (JP); Yasushi Iijima, Tokyo (JP); Tomotsugu Kuroda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/216,685

(22) Filed: Aug. 24, 2011

(65) Prior Publication Data

US 2012/0050412 A1 Mar. 1, 2012

(30) Foreign Application Priority Data

Aug. 27, 2010 (JP) ..... 2010-191216

(51) Int. Cl.
*B41J 2/05* (2006.01)

(52) U.S. Cl. ..... 347/65

(58) Field of Classification Search ..... 347/47, 347/54, 56, 61, 63, 65
See application file for complete search history.

(56) References Cited

U.S. PATENT DOCUMENTS 6,474,780 B1 * 11/2002 Kubota et al. ..... 347/45
7,513,601 B2 * 4/2009 Asai et al. ..... 347/47
8,100,505 B2 * 1/2012 Kuroda et al. ..... 347/47

FOREIGN PATENT DOCUMENTS

JP H06-091874 A 4/1994

* cited by examiner

*Primary Examiner* — An Do
(74) *Attorney, Agent, or Firm* — Canon USA Inc IP Division

(57) ABSTRACT

A liquid-ejecting head includes a recording element substrate that includes an energy generating element generating energy for ejecting a liquid from a discharge port, a supporting member that supports the recording element substrate and has a liquid chamber supplying the liquid to the recording element substrate, a first supply port formed in one surface thereof, communicating with the liquid chamber, and having fluid communication with the recording element substrate, a second supply port being smaller than the first supply port, formed in a surface opposite the one surface at a position corresponding to a longitudinal end side of the first supply port, and communicating with the liquid chamber, and a flow passage forming member that supplies the liquid to the second supply port. The cross-section of the liquid chamber in a direction extending from the opposite toward one surfaces gradually increases in part of the extending direction.

5 Claims, 8 Drawing Sheets

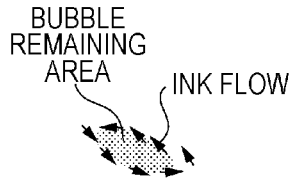
FIG. 6A
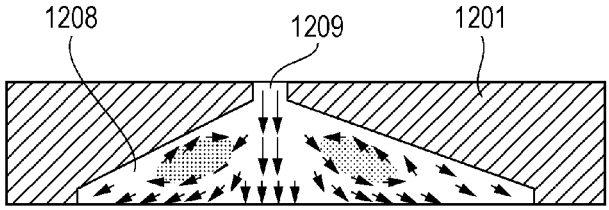
FIG. 6B
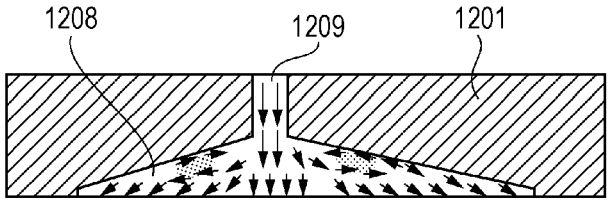
FIG. 6C
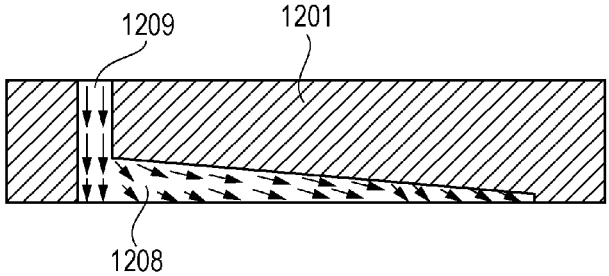
FIG. 6D
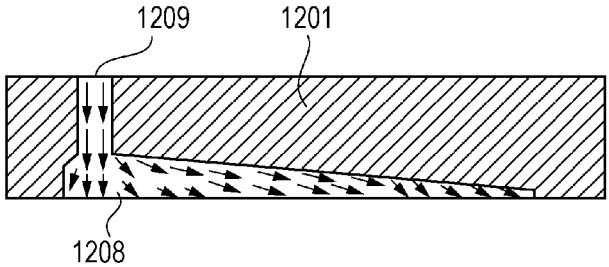

LIQUID-EJECTING HEAD

BACKGROUND OF THE INVENTION

1. Field of the Invention

The present invention relates to a liquid-ejecting head applied to a recording apparatus that performs a recording operation by ejecting a recording liquid (for example, ink).

2. Description of the Related Art

In some cases, bubbles remaining in a common liquid chamber that supplies ink to a recording element substrate that ejects the ink cause a problem in printing. To solve this problem, a technology is proposed in which a common liquid chamber is formed to have a shape diverging from an ink supply port toward the recording element substrate in order to prevent bubbles from staying (FIG. 1 in Japanese Patent Laid-Open No. 6-91874).

With such a structure as disclosed in Japanese Patent Laid-Open No. 6-91874, a difference in flow velocities of ink between nozzles at an end portion and at a central portion of a nozzle row is decreased during, for example, a suction and recovery operation, and accordingly, a good recovering property is obtained. However, for the purpose of increasing printing speed, the length of the nozzle row is further increased. As a result, part of an ink flow in the common liquid chamber becomes turbulent as illustrated in FIG. 9, thereby preventing bubbles from being sufficiently discharged from the common liquid chamber.

SUMMARY OF THE INVENTION

A liquid-ejecting head includes a recording element substrate provided with an energy generating element that generates energy used to eject a liquid from a discharge port, a supporting member that supports the recording element substrate and has at least one liquid chamber that supplies the liquid to the recording element substrate, a first supply port that is formed in one surface of the supporting member, communicates with the at least one liquid chamber, and is in fluid communication with the recording element substrate, and at least one second supply port that is formed in a surface opposite the one surface of the supporting member and communicates with the at least one liquid chamber, and a flow passage forming member that supplies the liquid to the at least one second supply port. In the liquid-ejecting head, the at least one second supply port that is smaller than the first supply port is formed at a position corresponding to one longitudinal end side of the first supply port, and a cross-section of the at least one liquid chamber perpendicular to a direction extending from the surface opposite the one surface of the supporting member toward the one surface of the supporting member gradually increases in part of the extending direction.

Further features of the present invention will become apparent from the following description of exemplary embodiments with reference to the attached drawings.

BRIEF DESCRIPTION OF THE DRAWINGS

FIGS. 6A to 6D are schematic diagrams illustrating flows of ink in differently shaped common liquid chambers in the supporting members, in which FIGS. 6A and 6B each illustrate a comparative example, FIG. 6C illustrates the first embodiment, and FIG. 6D illustrates a second embodiment.

DESCRIPTION OF THE EMBODIMENTS

Figure 1:
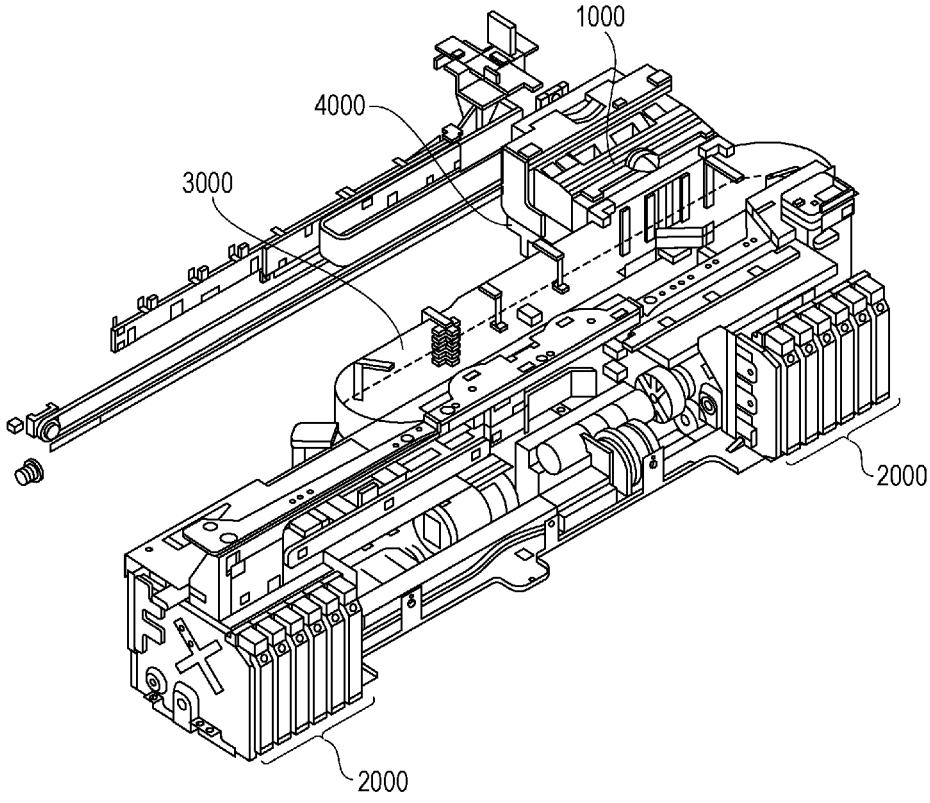
FIG. 1 illustrates a general configuration of an ink supplying system suitable for an embodiment according to the present invention.

Embodiments according to the present invention will be described below in detail with reference to the drawings. FIG. 1 is a general configuration of an inkjet recording apparatus suitable for an embodiment of a liquid-ejecting head according to the present invention. The inkjet recording apparatus of the embodiment according to the present disclosure is an inkjet recording apparatus that uses 12 different color inks in printing and includes a liquid-ejecting head 1000 on a carriage 4000. The carriage 4000 performs reciprocating motions in a width direction of a recording medium. The inkjet recording apparatus also includes 12 ink cartridges 2000 that are disposed on a recording apparatus main body side away from the carriage 4000. The ink cartridges 2000 are each filled with corresponding one of 12 color inks, which are supplied to a head unit. In addition, the inkjet recording apparatus includes an ink supply paths 3000 formed by flexible tubes. The ink supply paths 3000 connect the ink cartridges 2000 to the liquid-ejecting head 1000 such that the ink can flow between the ink cartridges 2000 and the liquid-ejecting head 1000.

The inkjet recording apparatus is provided with a recovery pump in order to maintain a correct ink ejection state of the liquid-ejecting head or in order to eliminate clogging in discharge ports and recover the correct ink-ejection state when clogging occurs. Recovering of the liquid-ejecting head is performed by sucking ink through the discharge ports using a negative pressure generated with the pump. The recovery pump can use a tube pump that generates a negative pressure using a change in volume within the flexible tube. The tube pump is advantageous in that the tube pump has a simple structure, thereby allowing a small lightweight pump to be structured at a low cost.

Figure 2:
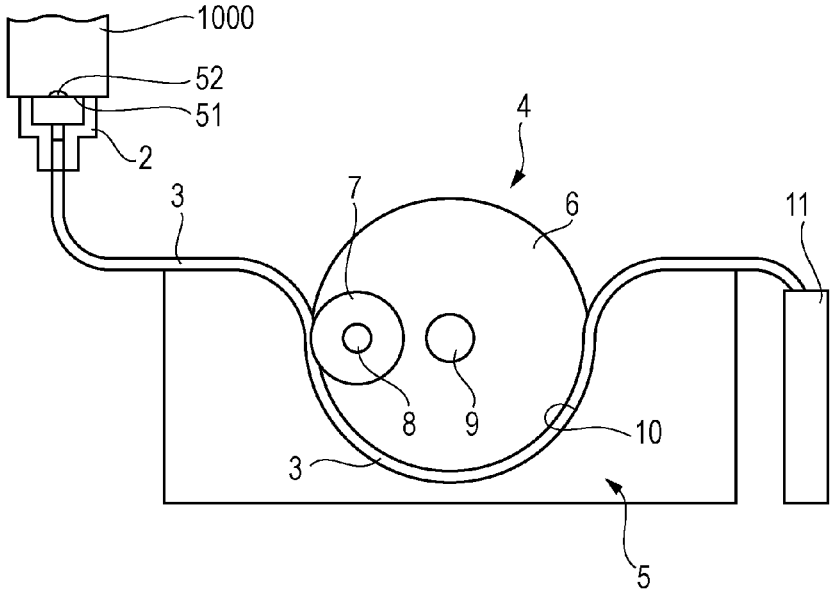
FIG. 2 is an explanatory diagram of a recovery system mechanism in a recording apparatus in which a liquid-ejecting head according to the present invention is mounted.

FIG. 2 is a sectional view illustrating a general configuration of the tube pump mounted in the inkjet recording apparatus. By bringing an opening of a cap 2 into contact with a surface 51 where discharge ports 52 of the liquid-ejecting head 1000 are formed, the discharge ports 52 are tightly closed. One end of a tube 3 is connected to a through hole in a rear surface of the cap 2. The tube 3 extends toward a tube pump 4. The tube pump 4 has a structure in which a guide roller 6 is rotatably supported by a pump base 5, and a pressing roller 7 is rotatably supported by the guide roller 6. That is, the pressing roller 7 that applies a pressure to the tube 3 includes a shaft 8, which is rotatably supported by the guide roller 6, and a shaft 9 of the guide roller 6 is rotatably supported by the pump base 5. The pump base 5 has a groove 10 formed therein having an arc shape so as to be concentric with the shaft 9 of the guide roller 6. The tube 3 is mounted in the groove 10. The other end (end portion on a downstream side) of the tube 3 is connected to a waste ink processing member 11 that reserves ink sucked through the discharge ports 52.

Figure 3:
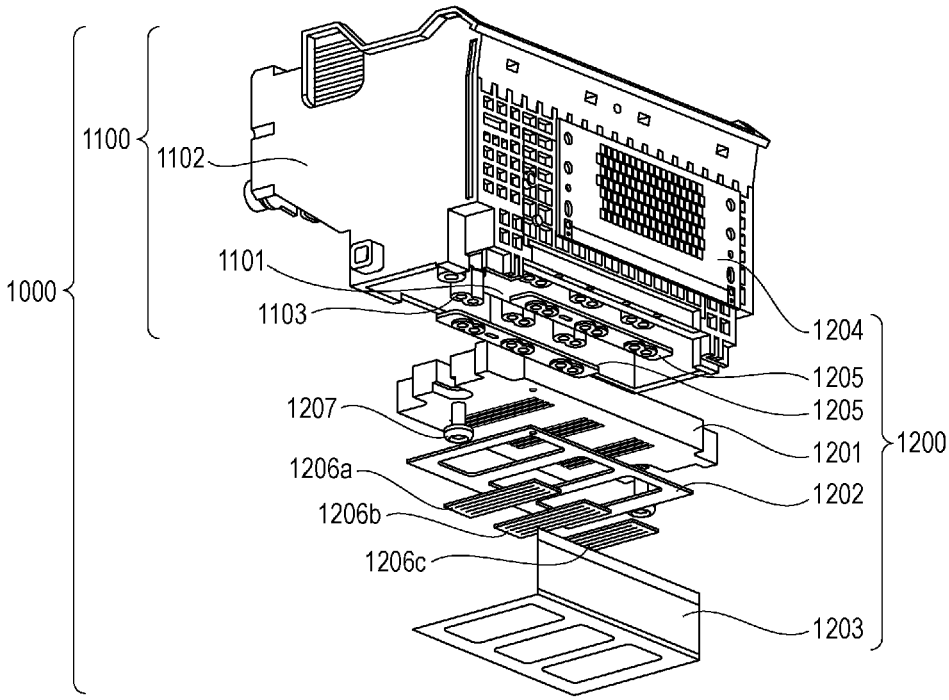
FIG. 3 is an exploded perspective view of the liquid-ejecting head according to the present invention.

Next, the liquid-ejecting head 1000 of the present embodiment will be described. FIG. 3 is an exploded perspective view of the suitable liquid-ejecting head 1000 according to the present invention. The liquid-ejecting head 1000 of the present embodiment includes an ink supply unit 1100 and a recording element unit 1200. The recording element unit 1200 receives ink as a recording liquid supplied from the ink supply unit 1100 and ejects the ink onto a recording medium.

The liquid-ejecting head 1000 is supported by the carriage 4000 placed on the inkjet recording apparatus main body such that the liquid-ejecting head 1000 is immovable using a positioning unit and electrical contacts of the carriage 4000. The liquid-ejecting head 1000 is detachable from the carriage 4000.

The recording element unit 1200 includes three recording element substrates 1206*a*, 1206*b*, and 1206*c*, a first supporting member 1201, a second supporting member 1202, electrical wiring tape 1203, and an electrical contact substrate 1204. The ink supply unit 1100 includes a flow passage forming member 1101 and a housing 1102 that holds sub-tanks.

The recording element substrates 1206 (1206*a* to 1206*c*) of the recording element unit 1200 each include energy generating elements on one of surfaces of an Si substrate having a thickness of 0.5 to 1 mm. The energy generating elements generate energy that is used to eject the liquid. In the present embodiment, the energy generating elements use electrothermal transducers. Electrical wiring that supplies the power to the electrothermal transducers is formed using a deposition method. A plurality of ink flow passages and a plurality of discharge ports corresponding to the electrothermal transducers are formed using a photolithography technology, and ink supply ports that supply the ink to the plurality of ink flow passages are formed so as to open on rear surfaces of recording element substrates 1206.

The recording element substrates 1206 are bonded to the first supporting member 1201 having ink supply ports. The second supporting member 1202 having openings is also bonded to the first supporting member 1201 and held such that the electrical wiring tape 1203 is electrically connected to the recording element substrates 1206 through the second supporting member 1202. The electrical wiring tape 1203 is provided in order to apply electrical signals for ejecting the ink to the recording element substrates 1206. The electrical wiring tape 1203 includes electrical wiring corresponding to the recording element substrates 1206 and external signal input terminals that are positioned at electrical wiring portions and receive electrical signals from a printer main body. The external signal input terminals are positioned and secured to a rear surface of the housing 1102.

The first supporting member 1201 is formed of, for example, a ceramic material such as alumina having a thickness of about 0.5 to 10 mm. Here, the material of the first supporting member 1201 is not limited to alumina. The first supporting member 1201 can be also formed of a material having a coefficient of linear expansion equal to that of the material of the recording element substrates 1206 and having a thermal conductivity greater than or equal to that of the material of the recording element substrates 1206. The material can be any one of, for example, silicon, aluminum nitride, zirconia, silicon nitride, silicon carbide, molybdenum, tungsten, and so forth.

Figure 4A:
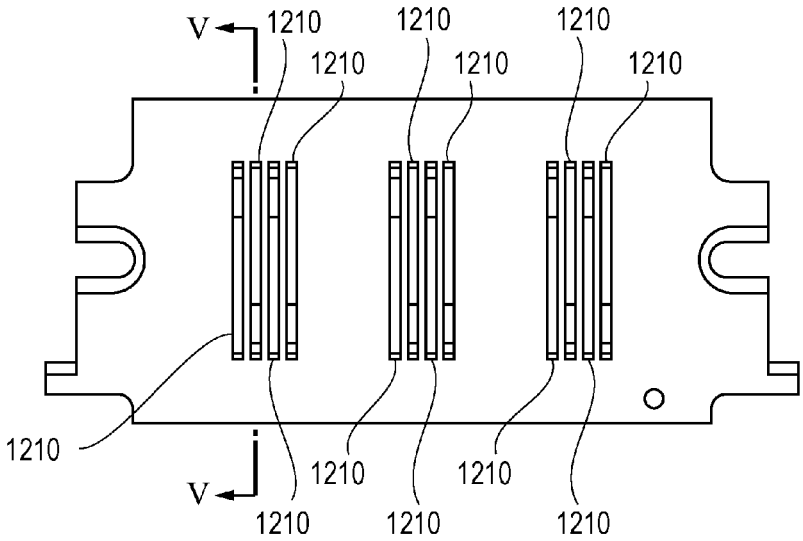
FIGS. 4A and 4B are diagrams illustrating a supporting member of the liquid-ejecting head of a first embodiment according to the present invention.
Figure 4B:
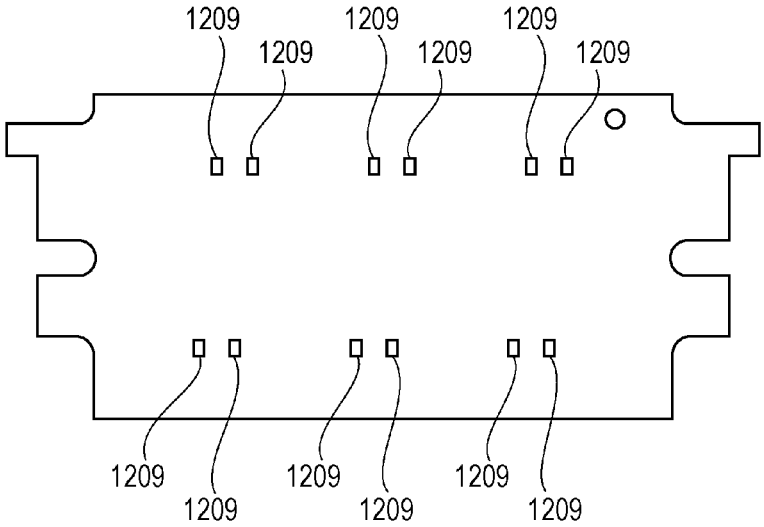

On one surface of the first supporting member 1201, which is a surface on the recording element substrate 1206 side, ink supply ports 1210 (first supply ports) are formed as illustrated in FIG. 4A, which supply the ink to the recording element substrates 1206. Here, 12 ink supply ports 1210 are formed corresponding to nozzle rows formed in the recording element substrates 1206. Although disclosed herein as 12 ink supply ports 1210, more or fewer ink supply ports 1210 may be used. As illustrated FIG. 4B, ink supply ports 1209 (second supply ports) are formed on a surface opposite the one surface of the first supporting member 1201. The ink supply ports 1209 supply the ink from the flow passage forming member 1101 formed of a polymer material. As illustrated in the figure, the ink supply ports 1209 are staggered in a direction in which a plurality of common liquid chambers 1208 are disposed. The ink supply ports 1209, the corresponding ink supply ports 1210 and the corresponding common liquid chambers 1208 are in fluid communication with each other. The opening of each ink supply port 1209 is formed to have a smaller area than that of the ink supply port 1210. The ink supply ports 1209 are each disposed on an end portion in a longitudinal direction of the corresponding common liquid chamber 1208 (refer to FIG. 5), and the ink supply ports 1209 of the adjacent common liquid chambers 1208 are disposed on longitudinal end sides opposite to each other. This at least increases the freedom with which joint ports 1103 can be arranged in the flow passage forming member 1101 with respect to space. Since the ink supply ports 1209 and the joint ports 1103 are substantially equally spaced, connecting members 1205 formed of an elastic material need not have different shapes. The connecting members 1205 of the same shape can be applied at two positions. This is advantageous in terms of the cost.

Electrical connection portions between the recording element substrates 1206 and the electrical wiring tape 1203 are sealed with a first sealant (not shown) and a second sealant (not shown), thereby protecting the electrical connection portions from corrosion caused by ink or external shocks. The first sealant mainly seals rear sides of connection portions where electrode terminals of the electrical wiring tape 1203 are connected to bumps of the recording element substrates 1206, and peripheral portions of the recording element substrates 1206. The second sealant seals the front sides of this connection portions.

In addition, the electrical contact substrate 1204 is electrically connected to an end portion of the electrical wiring tape 1203 by heat press bonding using an anisotropic conductive film or the like. The electrical contact substrate 1204 includes external signal input terminals that receive electrical signals from the printer main body.

The ink supply unit 1100 includes the housing 1102 and the flow passage forming member 1101. The housing 1102 holds the sub-tanks (not shown) provided in order to store the ink supplied from the printer main body side, and the flow passage forming member 1101 directs the ink from the sub-tanks to the recording element unit 1200.

Here, the housing 1102 and the flow passage forming member 1101 are welded by ultrasonic welding so as to form paths, each of which supplies the corresponding ink to the recording element unit 1200.

The liquid-ejecting head 1000 according to the present embodiment is complete by integrating the ink supply unit 1100 and the recording element unit 1200. The connecting members 1205 are provided between the ink supply ports 1209 of the common liquid chambers 1208 on the flow passage forming member 1101 side and the joint ports 1103 of the ink supply unit 1100 in order to prevent the ink from leaking. Screws 1207 are fastened so as to clamp the connecting member 1205. In so doing at the same time, the recording element unit 1200 is correctly positioned relative to datum points of the ink supply unit 1100 in the X, Y, and Z directions, and secured.

Figure 5:
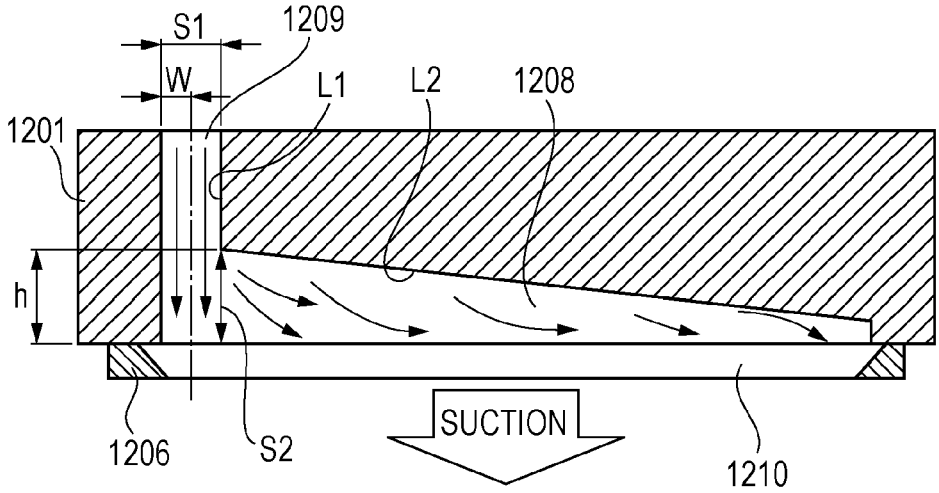
FIG. 5 is a schematic diagram illustrating a sectional view of the supporting member taken along line V-V in FIG. 4A and flow of ink.

A first embodiment according to the present invention will be described in detail below with reference to the drawings. FIG. 5 is a side sectional view taken along line V-V in FIG. 4A, illustrating a state in which the recording element substrate 1206 are secured to the first supporting member 1201 according to the present invention.

The common liquid chambers 1208 are formed in the first supporting member 1201 in order to stably supply the ink. The common liquid chambers 1208 have a generally tapered shape in which the cross-sectional area thereof decreases from the ink supply port 1210 on the recording element substrate 1206 side toward the joint port 1103 of the flow passage forming member 1101. That is, each common liquid chamber 1208 has a portion, in which, in a direction from the ink supply port 1209 connected to the joint port 1103 of the flow passage forming member 1101 toward the ink supply port 1210, the cross sectional area perpendicular to this direction gradually increases. Here, the ink supply port 1209 to which the ink is supplied from the flow passage forming member 1101 is provided near a position immediately above an end portion of the corresponding recording element substrate 1206 in a longitudinal direction of the ink supply port 1210. The angle formed by an edge line of the common liquid chamber 1208 formed in the first supporting member 1201 is smaller than or equal to 90°. As illustrated in FIG. 5, the ink supply port 1209 is formed at a position corresponding to a longitudinal end side of the ink supply port 1210.

In the present embodiment, the thickness of the first supporting member 1201 is set to about 8 mm, the length of the ink supply port 1210 of the first supporting member 1201 is set to about 23.2 mm on a surface that supports the recording element substrate 1206. The length of the ink supply port 1209 is set to about 2 mm on the side where the first supporting member 1201 is connected to the flow passage forming member 1101, and the width of the common liquid chamber 1208 is set to about 1 mm over the entire length.

In the related-art structure, the thickness of the first supporting member 1201 is about 4 mm. This thickness is used to minimize the amount of suction in a recovery operation. The thickness of 4 mm is also required in order to accommodate the amount of heat necessary for suppressing a temperature rise due to heat generated by the recording element substrates 1206 during printing. However, as illustrated in FIGS. 3 and 4, the liquid-ejecting head 1000 of the structure of the present embodiment has three recording element substrates 1206 each having four discharge port rows are arranged side by side on the first supporting member 1201. In addition, each of the discharge port rows has a length longer than that of the related-art discharge port row, and accordingly, the amount of heat generated during printing significantly increases compared to that of the liquid-ejecting head of the related art. In order to achieve a temperature rise value equal to that of the related art liquid-ejecting head with the liquid-ejecting head 1000 as above generating a large amount of heat, the thickness of the first supporting member 1201 was increased. It was observed that, when the common liquid chamber 1208 was formed in the first supporting member 1201 having such a thickness, and the structure of the common liquid chamber 1208 was such that the ink supply port 1209 was formed close to a central portion as that of the related-art was, branch points where flows of the ink were branched into backward flows in which the ink flowed from the ink supply port 1210 toward the ink supply port 1209 and forward flows in which the ink flowed in a direction opposite the backward flows were formed in quite lower areas in the common liquid chamber 1208, and bubbles tended to stay in those areas (FIG. 6A). In order to solve the above problem, as illustrated in FIG. 6B, a structure in which the height of the common liquid chamber 1208 was decreased to 3 mm was examined. Despite this change, bubbles still tended to stay.

Then, the ink supply port 1209 was formed at the end portion of the common liquid chamber 1208 as illustrated in FIG. 5, and a liquid was supplied thereinto. As a result, although some branch points where the ink flows branched into the backward and forward flows were still formed, the areas where the branch points were formed existed close to a ceiling of the liquid chamber (close to the edge line of the common liquid chamber 1208). Thus, it has been found that, in this structure, the backward flows are quite weak, and bubbles are less likely to stay (FIG. 6C). By forming the ink supply port 1209 on the end portion side of the common liquid chamber 1208 as above, bubbles remaining in the common liquid chamber 1208 formed in the first supporting member 1201 decreases and a good recovering property can be obtained.

Next, a second embodiment according to the present invention illustrated in FIG. 6D will be described. In the second embodiment, as illustrated in FIG. 6D, the ink supply port 1209 is shifted toward the central portion by 1 mm from the end portion of the common liquid chamber 1208. With a degree of a shift as above, a flow of the ink in the recovery operation can be still directed in a direction from the flow passage forming member 1101 side through the ink supply port 1209 toward the end opposite the ink supply port 1209, and accordingly, the property of discharging bubbles can be ensured.

In order to evaluate a performance of the liquid-ejecting head 1000 according to the present embodiments in eliminating bubbles, the first embodiment, the second embodiment, a first comparative example that is the structure illustrated in FIG. 6B, and a second comparative example that is the structure illustrated in FIG. 6A are compared under the same suction conditions. The results obtained are listed in Table 1. In Table 1, "A" indicates that bubbles are substantially completely eliminated, and "B" indicates that, although some bubbles still remain, they do not affect printing. Also in Table 1, "C" indicates that printing can be initially performed, however when printing is continued, the ejection gradually fails due to effects of bubbles, and "D" indicates that bubbles cannot be successfully discharged and the ejection immediately fails.

According to the results in Table 1, by disposing the ink supply port 1209 at the end portion of the common liquid chamber 1208 in the first supporting member 1201, more advantageous effects can be obtained. As the height h of the common liquid chamber 1208 (refer to FIG. 5) is decreased, the flow velocity at which the ink, which is supplied from the flow passage forming member 1101 through the ink supply port 1209, flows toward the opposite end portion of the common liquid chamber 1208 further increases. Thus, the common liquid chamber 1208 with lower height is more advantageous. However, when the height of the common liquid chamber 1208 is excessively decreased, there is the possibility of gradual growth of bubbles generated during printing or storage, or the possibility of easily causing failures in supplying the ink in such a time as when the ink having reached the recording element substrate 1206 is used in printing.

In addition, as illustrated in FIG. 5, when a cross-sectional area of the ink supply port 1209 from the flow passage forming member 1101 is S1, and the cross-sectional area corresponding to a perpendicular from an intersection of L1 and L2 toward the recording element substrate 1206 side in the common liquid chamber 1208 is S2, it is advantageous that S1 is set to a large value in relation to S2. According to the present embodiment, S1 and S2 are preferably set to as follows: S2/S1≦1.5. Here, S2 is the maximum cross sectional area of the common liquid chamber 1208 in a direction extending from the ink supply port 1209 toward the ink supply port 1210 (top to bottom direction in FIG. 5).

TABLE 1

| | 1st Embodiment | 2nd Embodiment | 1st Comparative Example | 2nd Comparative Example |
|---|---|---|---|---|
| S2/S1 | 1.5 | 1.5 | 1.5 | 2.5 |
| h (mm) | 3 | 3 | 3 | 5 |
| W (mm) | 1 | 2 | 11.6 | 11.6 |
| Bubble Discharge Property | A | B | C | D |

Figure 7A:
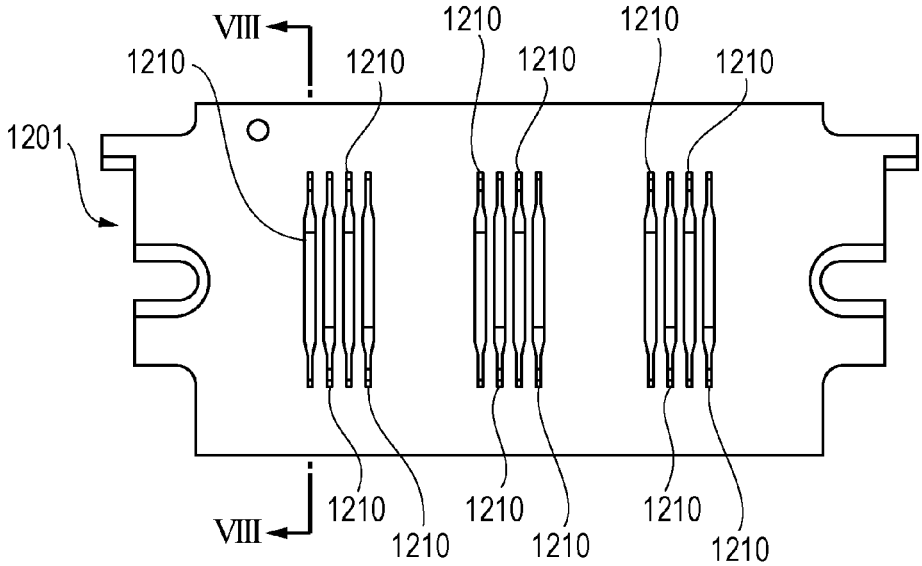
FIGS. 7A and 7B are diagrams illustrating a supporting member of a liquid-ejecting head of a third embodiment according to the present invention.
Figure 7B:
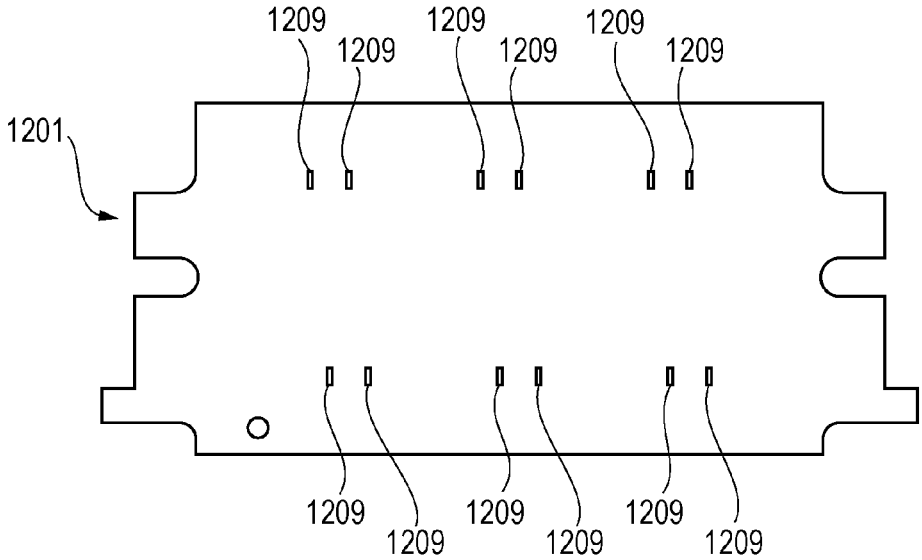
Figure 8:
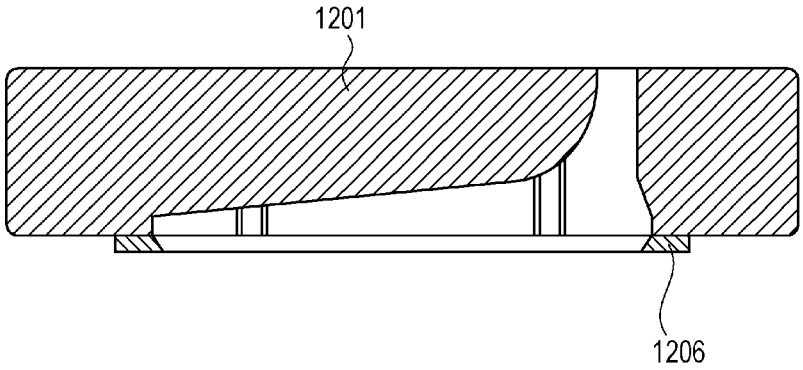
FIG. 8 is a sectional view of the supporting member taken along line VIII-VIII in FIG. 7A.
Figure 9:
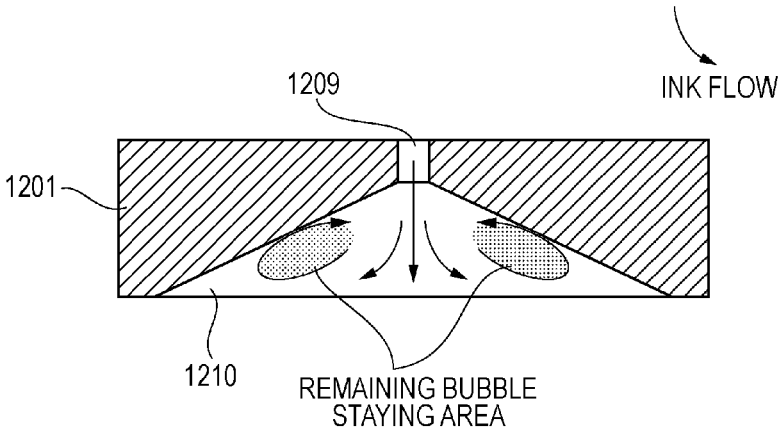
FIG. 9 is a schematic diagram illustrating flows of ink in a common liquid chamber of a related-art structure.

FIGS. 7A and 7B illustrate the structure of the liquid-ejecting head of a third embodiment according to the present invention. FIG. 8 illustrates a sectional view of the structure illustrated in FIG. 7A taken along line VIII-VIII. Similar to the structure in FIG. 4 described in the first embodiment, the first supporting member 1201 is formed of an alumina ($Al_2O_3$) material having a thickness of about 0.5 to 10 mm. In the present embodiment, the thickness of the first supporting member 1201 is set to about 8 mm, and the length and the width of an opening of the ink supply port 1210 are respectively set to about 23 mm and about 1 mm except for an area about 4 mm from each end of the ink supply port 1210, of which the width of the opening is set to about 0.65 mm. By decreasing the width of the opening at each end of the ink supply port 1210 compared to the central portion of the ink supply port 1210 as described above, the flow velocity in those areas can be relatively increased, thereby allowing the property of discharging remaining bubbles that tend to stay at the end portions to be improved.

When the recovering property was examined using the liquid-ejecting head according to the present invention, a small number of bubbles remained in the common liquid chamber 1208 of the first supporting member 1201, and a good recovering property was obtained without applying an excessive load to a recovery mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191216 filed Aug. 27, 2010, which is hereby incorporated by reference herein in its entirety.

What is claimed is:

1. A liquid-ejecting head comprising:

a recording element substrate provided with an energy generating element that generates energy used to eject a liquid from a discharge port;

a supporting member that supports the recording element substrate, the supporting member having at least one liquid chamber that supplies the liquid to the recording element substrate, a first supply port that is formed in one surface of the supporting member, the first supply port communicating with the at least one liquid chamber and being in fluid communication with the recording element substrate, and at least one second supply port that is formed in a surface opposite the one surface of the supporting member, the at least one second supply port communicating with the at least one liquid chamber; and a flow passage forming member that supplies the liquid to the at least one second supply port, wherein, the at least one second supply port that is smaller than the first supply port is formed at a position corresponding to one longitudinal end side of the first supply port, wherein a cross-section of the at least one liquid chamber perpendicular to a direction extending from the surface opposite the one surface of the supporting member toward the one surface of the supporting member gradually increases in part of the extending direction.

2. The liquid-ejecting head according to claim 1, wherein, when the cross-sectional area of the at least one second supply port in the direction perpendicular to the extending direction is S1, and the maximum cross-sectional area of the at least one liquid chamber in the extending direction is S2, and wherein the ratio of S2 to S1 is less than or equal to 1.5.

3. The liquid-ejecting head according to claim 1, wherein the at least one liquid chamber has a plurality of liquid chambers formed so as to be arranged side by side, wherein the at least one second supply port has a plurality of the second supply ports that are staggered in a direction in which the plurality of liquid chambers are arranged.

4. The liquid-ejecting head according to claim 1, wherein the flow passage forming member is connected to the supporting member with a connecting member therebetween.

5. The liquid-ejecting head according to claim 1, wherein the thickness of the supporting member is greater than or equal to 5 mm, wherein the height of the liquid chamber is less than or equal to 3 mm.

* * * * *